US005655882A

United States Patent [19]

Morgan et al.

[11] Patent Number: 5,655,882

[45] Date of Patent: Aug. 12, 1997

[54] FAN ASSEMBLY AND METHOD

[75] Inventors: Phillip D. Morgan, Noblesville; Kevin M. Cahill, Fishers; Phillip B. Cutler, Indianapolis, all of Ind.

[73] Assignee: Engineered Cooling Systems, Inc., Indianapolis, Ind.

[21] Appl. No.: 641,909

[22] Filed: May 2, 1996

[51] Int. Cl.[6] ..... F04D 29/34

[52] U.S. Cl. ..... 416/204 R; 416/229 R

[58] Field of Search ..... 416/241 A, 204 R, 416/223 R, 229 R

[56] References Cited

U.S. PATENT DOCUMENTS

| | | | |
|---|---|---|---|
| 2,212,072 | 8/1940 | Newnham . | |
| 3,147,811 | 9/1964 | Klonoski | 416/204 |
| 3,251,307 | 5/1966 | Amirault et al. | 416/204 |
| 3,279,684 | 10/1966 | Waters | 416/204 |
| 3,318,388 | 5/1967 | Bihlmire . | |
| 4,826,405 | 5/1989 | Robb | 416/204 |
| 4,957,414 | 9/1990 | Willingham | 416/241 A |
| 5,297,936 | 3/1994 | Sato | 416/204 |
| 5,358,382 | 10/1994 | Muhlbach | 416/204 |

FOREIGN PATENT DOCUMENTS

| | | | |
|---|---|---|---|
| 165600 | 9/1983 | Japan | 416/204 |

*Primary Examiner*—John T. Kwon

*Attorney, Agent, or Firm*—Brings Hofer Gilson & Lione

[57] ABSTRACT

The invention provides a more durable composite fan assembly with a metal hub including a portion adapted for rotation and for engagement with a plastic body and including at least one peripheral portion offset from its plane of rotation, and a plastic body forming a plurality of air-moving blades molded in engagement with the offset peripheral portion of the metal hub. The offset peripheral portion of the metal hub can comprise a number of configurations, for example, it can comprise one or more annular portions formed adjacent the periphery of the hub, including but not limited to, a complete annulus offset from the plane of rotation of the hub periphery. The offset peripheral portion can also comprise one or more portions at the periphery of the metal hub, which are out of the plane of rotation, preferably so that at least two offset portions extend out of the plane of rotation at an acute angle of about 10° to 30° on one or both sides of their plane of rotation. The offset portion may be formed by a plurality of peripheral portions which are formed to provide a wavy peripheral portion of the metal hub, including, for example, a plurality of joined waffle-like peripheral segments that are alternatingly displaced in both directions from the plane of rotation of the peripheral portion of the central hub.

42 Claims, 6 Drawing Sheets

FAN ASSEMBLY AND METHOD

This invention relates to fan assemblies and, more particularly, to fan assemblies comprising a metal hub adapted for rotation and for engagement with a plastic body forming a plurality of air-moving blades and methods for reducing stress concentrations in plastic bodies molded in engagement with such metal hubs.

BACKGROUND OF THE INVENTION

Fans are used on a variety of equipment for cooling purposes and are frequently used to provide air flow through the cooling system of an internal combustion engine during its operation. Such fans can be quite large with diameters most frequently between 12 to 48 inches in diameter. Such fans are frequently formed from assemblies including a central metal hub adapted to be driven by the internal combustion engine or other mechanical or hydraulic means with a plurality of air-moving blades formed from an outer plastic body molded into engagement with the central metal hub, and such composite fans are frequently preferred because they are lighter, less expensive to manufacture and consume less power from the driving source.

Substantial forces are imposed on fans during their operation. The forces imposed on the fan blade surfaces as they are moved against and in the surrounding air generate substantial forces on and within the individual blades themselves and at their connection with the central driving hub. In addition, since such fans are rotated at speeds from several thousand revolutions per minute, substantial centrifugal forces are developed. In addition to the forces of air resistance and the centrifugal forces of rotation, forces are sporadically imposed on the fan by misfiring of the internal combustion engine's cylinders, drive train vibration, gusting winds and other unpredictable sources of force.

The resulting effect of such forces is particularly troublesome where it is desirable to form the blades themselves with molded plastic material. First, plastic materials, such as nylon, polypropylene and the like, are not as strong as metals such as steel and aluminum. Therefore, it is desirable to utilize design methods to improve the strength of the plastic body.

To improve the strength of bodies formed from plastic materials, it is common to incorporate into the body of the plastic materials fiber-reinforcement, such as fiber glass having fiber lengths as small as 20 thousandths of an inch and as long as manufacturing processes allow. Such fiber reinforced plastic materials are commonly available from suppliers such as DuPont. The inclusion of reinforcing fibers in parts formed from plastic materials improves their sensitivity to stress concentrations and increases the modulus of elasticity, elastic limit, and ultimate strength of the plastic materials; however, such materials still fail to provide the strength of metals and it remains more difficult to obtain a durable and reliable composite fan assembly with a plastic blade-forming element.

The problems of providing durable and reliable composite blade assemblies is compounded, not only by the internal stresses generated within the plastic blade-forming portion, but at the interface between the plastic blade-forming portion and the central driven hub. There is little or no adhesion between the peripheral plastic blade-forming portion and the central driven hub, and the interface between the peripheral plastic portion and the driven central hub must bear and survive the forces imposed on the peripheral blade-forming portion by its rotation, including the driving forces imposed at the interface by the driving mechanism and the air resistance on the blades and any shock loads that may be imposed during operation of the fan assembly.

U.S. Pat. No. 4,957,414 discloses a composite fan assembly including a central metal hub with a plurality of arms and a plastic fan structure molded to the periphery of the central hub. In the fan and hub assembly of U.S. Pat. No. 4,957,414, an attempt was made to increase the durability and reliability of the fan assembly by forming openings in the central metal hub and arms of predetermined sizes and positions to, not only, provide a driving interface between the central metal hub and the peripheral plastic portion, but to achieve a predetermined resonant frequency of the fan blades when molded to the hub. In addition, the arms of the central hub are formed with a smoothly curving profile, devoid of corners, to avoid the formation of stress points in the fan blades that are molded onto the central metal hub.

BRIEF SUMMARY OF THE INVENTION

The invention provides a more durable composite fan assembly with a metal hub including a portion adapted for rotation and for engagement with a plastic body and including at least one peripheral portion offset from its plane of rotation, and a plastic body forming a plurality of air-moving blades molded in engagement with the offset peripheral portion of the metal hub. The offset peripheral portion of the metal hub can comprise a number of configurations, for example, it can comprise one or more annular portions formed adjacent the periphery of the hub, including but not limited to, a complete annulus offset from the plane of rotation of the hub periphery. The offset peripheral portion can also comprise one or more portions at the periphery of the metal hub, which are out of the plane of rotation, preferably so that at least two offset portions extend out of the plane of rotation at an acute angle of about 10° to 30° on one or both sides of their plane of rotation. The offset portion may be formed by a plurality of peripheral portions which are formed to provide a wavy peripheral portion of the metal hub, including, for example, a plurality of joined waffle-like peripheral segments that are alternatingly displaced in both directions from the plane of rotation of the peripheral portion of the central hub.

Such metal hubs may be inexpensively formed from a metal sheet by a single tool that simultaneously forms the hub and the offset peripheral portion or portions. The central portion of the metal hub can be planar, or can include a central planar portion about the axis of rotation and a frustoconical annular portion between the central planar portion and the peripheral portion adapted for engagement with the plastic body. In composite fan assemblies of the invention, the peripheral portion can be further adopted for engagement with the plastic body by including a plurality of apertures to engage the molded plastic body.

Composite blades of the invention provide durable and reliable fan assemblies that better accommodate the forces imposed upon the blade assembly during its operation and rotation, with substantially reduced stress concentrations within the plastic blade portion and at its interface with the driven central hub. The invention provides a method of reducing stress concentration in the plastic body which is molded to the central metallic hub by providing the periphery of the central hub that interfaces the plastic body with the at least one peripheral segment that is displaced from the central hub in the direction of its axis of rotation, preferably by peripheral segments uniformly spaced about the periphery of the central hub and offset in both directions from their plane of rotation along its central axis. Thus, with the invention higher loads can be imposed on the plastic portion of the composite fan assembly with lower stress concentrations and reduced risk of part failure.

Other features and advantages of the invention will be apparent to those skilled in the art from the drawings and more detailed description of the invention that follows.

DETAILED DESCRIPTION OF THE DRAWINGS

Figure 2:
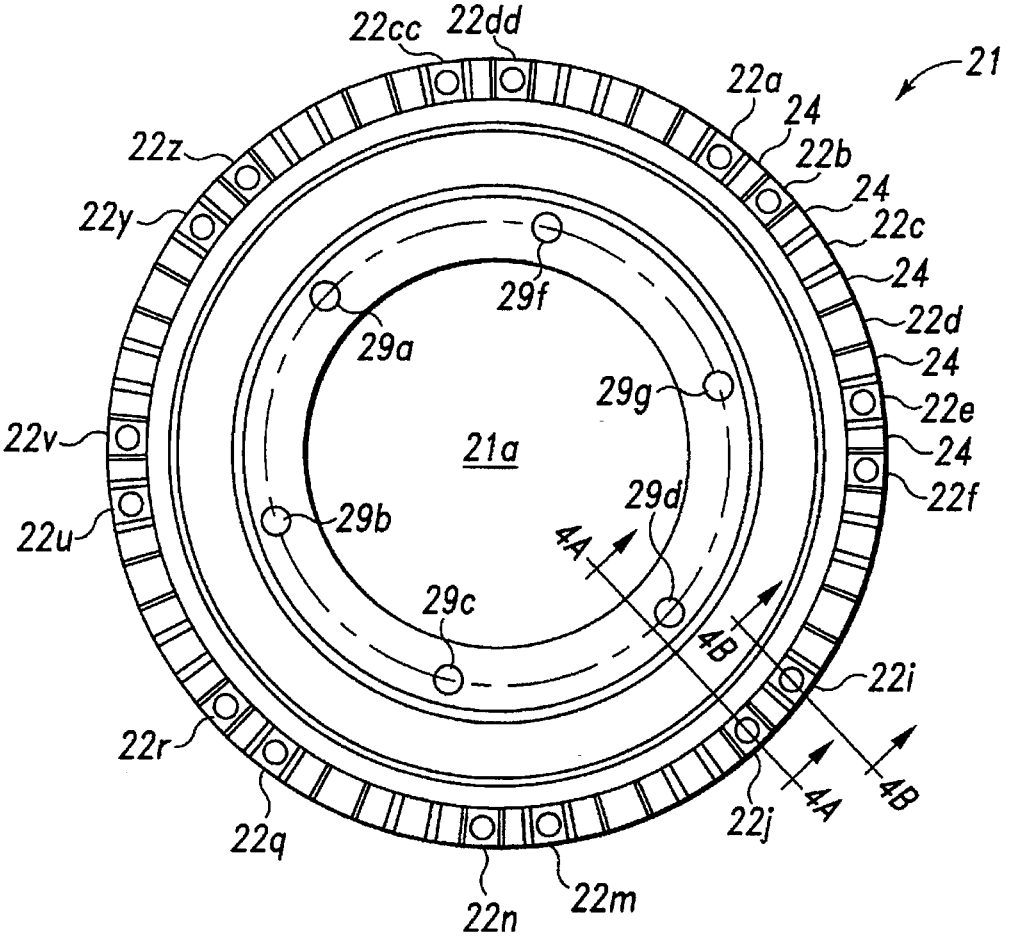
FIG. 2 is a plan view from above the metal hub of FIG. 1.
Figure 5B:
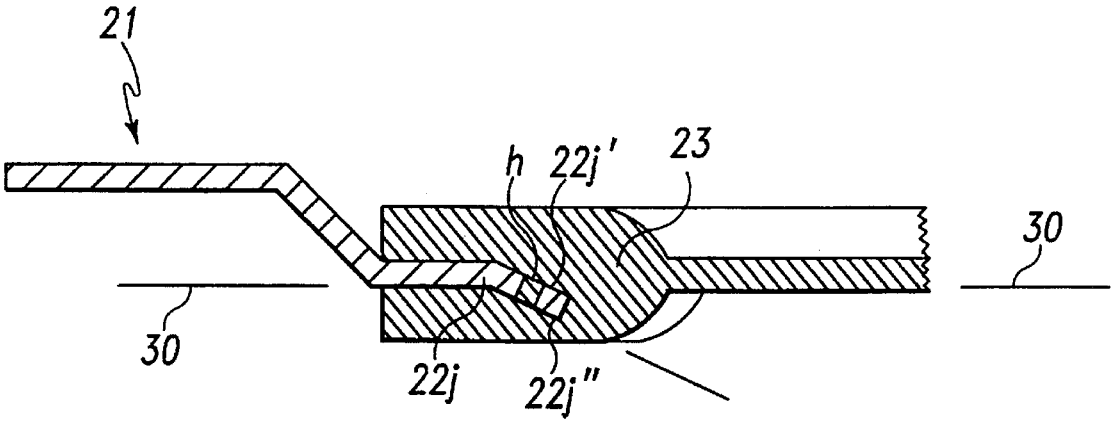
FIG. 5A is a prospective view of a composite fan assembly of the invention.
Figure 5A:
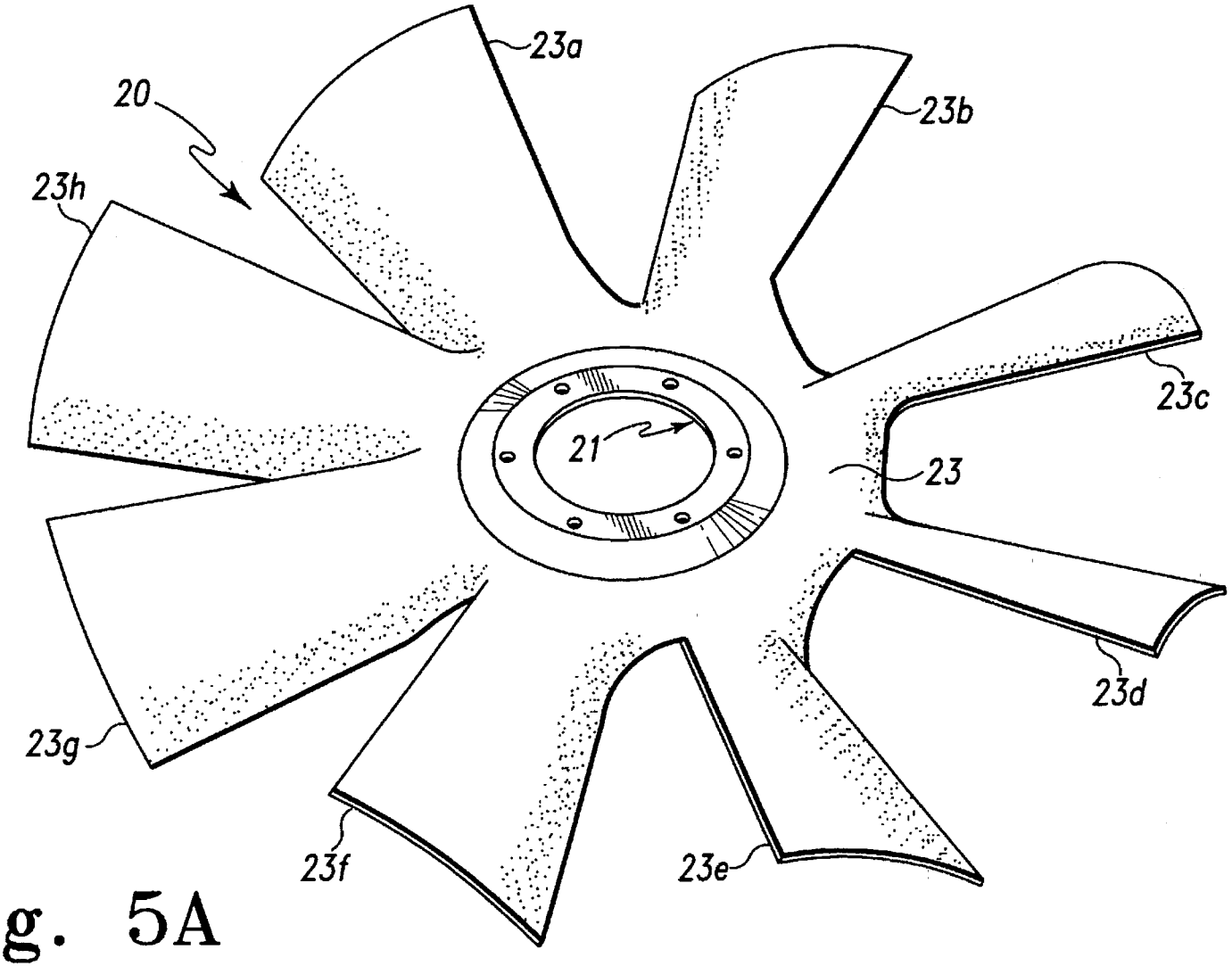

FIG. 5B is a cross-sectional view of the composite fan assembly of FIG. 5A taken at the plane corresponding to line 4A—4A of FIG. 2 to illustrate the engagement of the peripheral hub portion of the central hub and the plastic body in that plane; and FIGS. 6–12 are prospective drawings of segments taken from central hubs of the invention to illustrate various peripheral portions of a central hub including offsets from its plane of rotation for engagement with a peripheral plastic body.

DETAILED DESCRIPTION OF BEST MODE OF THE INVENTION

FIGS. 1–5B illustrate the embodiment of the invention which has been selected for commercialization, and FIGS. 6–12 indicate alternate embodiments that may also be used in the invention. It is not currently known whether any one or more of the embodiments illustrated in FIGS. 6–12 would be a better mode than that illustrated in FIGS. 1–5B.

Where, in this application, we refer to the blade-forming portion of a composite blade assembly as comprising "plastic", it should be understood that we are referring to any one of numerous organic polymeric materials that are mostly thermoplastic or thermosetting polymers of high molecular weight and that can be molded or cast into body that forms a plurality of air-moving blades. Plastics preferably used in the invention are nylon or polypropylene, reinforced with glass fibers, as previously described. Such materials are preferred in forming composite fans. The central hubs of the invention are preferably formed from sheet steel having a thickness up to 3/16 inch and typically, for example, in the preferred embodiment shown in FIGS. 1–5B, of about 0.134 inches.

FIGS. 1–5B illustrate one preferred fan assembly 20 of the invention; FIG. 5A illustrates a completed fan assembly 20 and FIGS. 1–4 illustrate a metal hub 21 of the invention adapted for rotation and for engagement with a plastic body 23 forming a plurality of air-moving blades 23*a*–23*h*. Although eight air-moving blades 23*a*–23*h* are illustrated in FIG. 5A, any number of blades may be included in fan assemblies of the invention.

Figure 1:
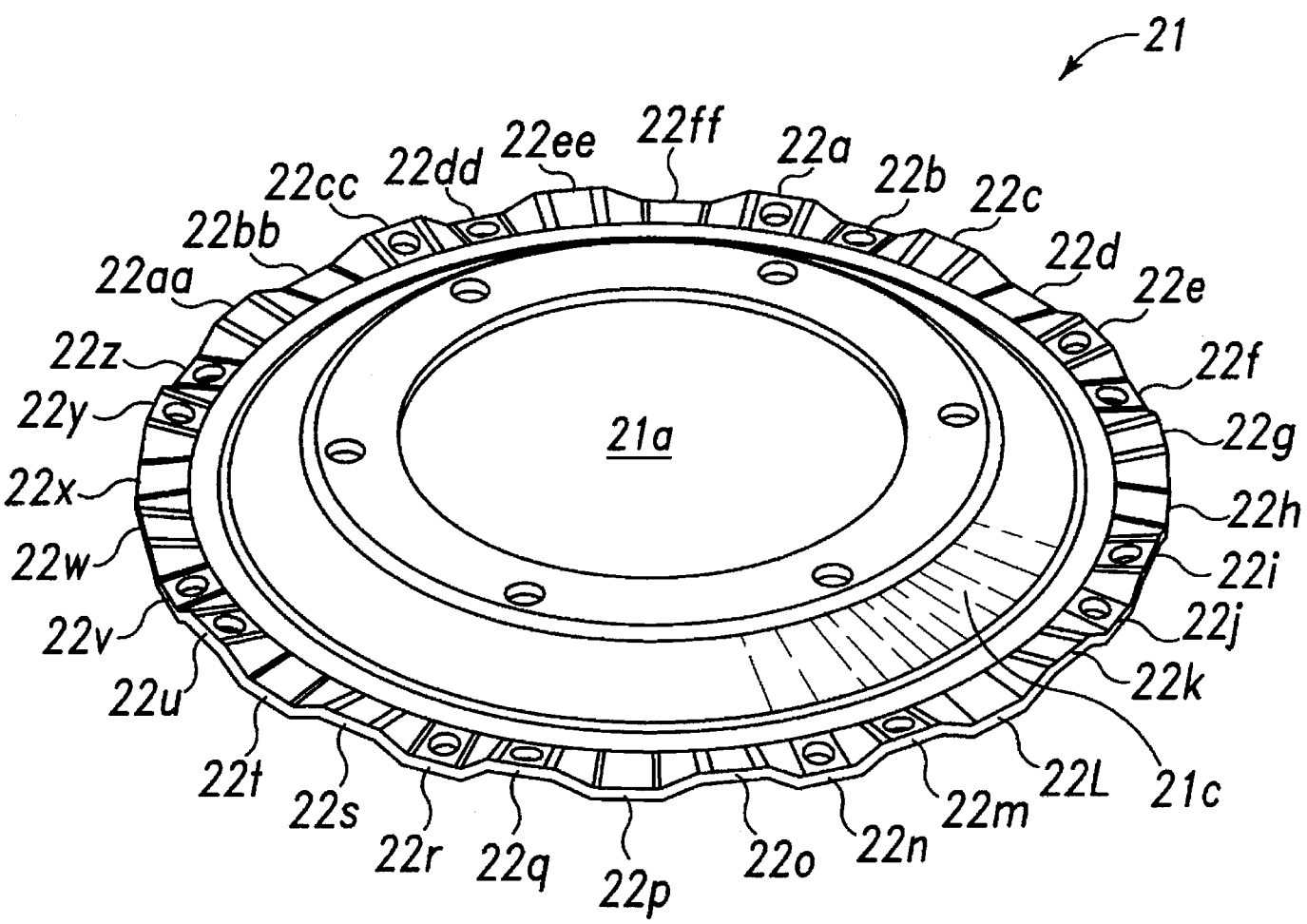
FIG. 1 is a prospective view of a preferred metal hub of the invention formed at its periphery for engagement with a plastic body forming a plurality of air-moving blades, as illustrated in FIG. 5A.

As shown in FIGS. 1, 2 and 5A, the metal hub 21 is adapted for rotation by a plurality of holes 29*a*–*f* formed in the central portion 21*a* of the metal hub. Holes 29*a*–*f* permit the metal hub to be engaged and fastened to a driven rotating hub by bolts, fasteners, studs on the driven hub, or by other conveniently usable and reliable methods. Although the composite fan assembly is illustrated in this application with holes to be used in fastening it to a driving hub, other means such as projecting shaft connected to the central hub for engagement by the motive agency, or other such means known to those skilled in the art. The central portion 21*a* may be formed as shown in FIGS. 1–8, with a frustoconical annular portion surrounding a planar center, or may be entirely planar as shown in FIGS. 9–12.

Figure 3:
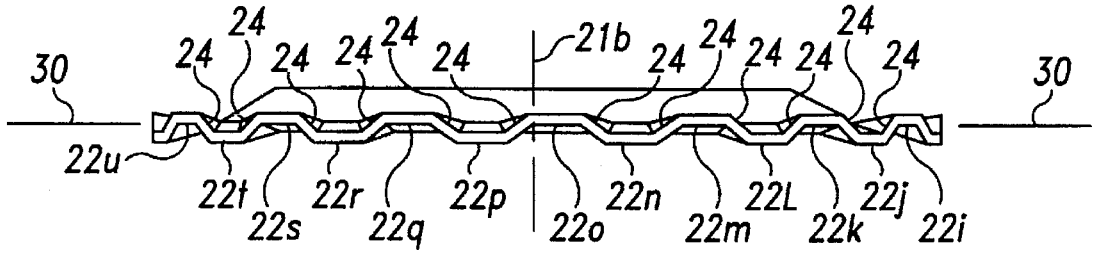
FIG. 3 is a view from the side of the metal hub of FIGS. 1 and 2.
Figure 4A:
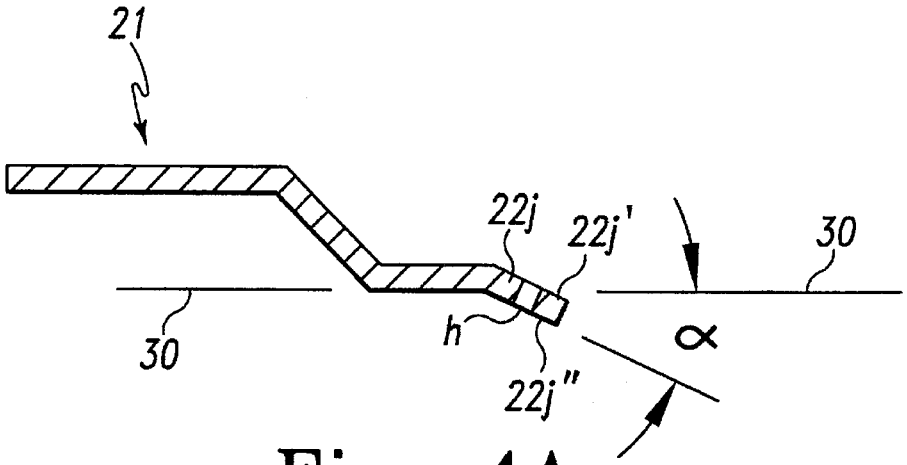
FIG. 4A is a partial cross-sectional view taken at the plane corresponding to line 4A—4A of FIG. 2.
Figure 4B:
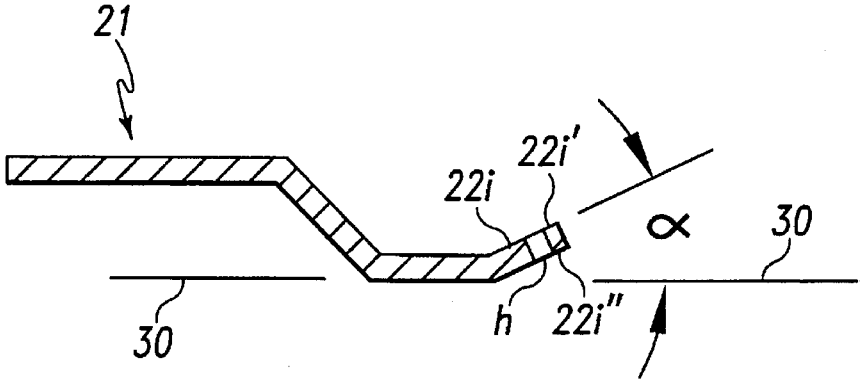
FIG. 4B is a partial cross-sectional view taken at the plane corresponding to line 4B—4B of FIG. 2.

As shown in FIGS. 1–4, the portion 21*a* of the metal hub adapted for rotation includes a peripheral portion 22 offset from its plane of rotation indicated by the line 30 of FIGS. 3, 4A, 4B and 5B. (The plane of rotation comprises the plane perpendicular to the sheets on which FIGS. 3, 4A, 4B and 5B appear that includes the line 30.) In the preferred embodiment illustrated in FIGS. 1–5B, peripheral portion 22 comprises a plurality of joined waffle-like peripheral segments 22*a*–22*ff* that are alternatingly displaced in both directions from the plane of rotation 30, as illustrated in FIGS. 4A and 4B. As apparent from FIGS. 1–3 the offset peripheral portion 22 is formed by alternatingly bending short peripheral segments 22*a*–22*ff* of the metal hub at an acute angle $\alpha$ (see FIGS. 4A and 4B) from the plane of rotation. Preferably, the offset segments 22*a*–22*ff* extend out of the plane of rotation at an acute angle from about 10° up to about 30°, although greater angles may be used in the invention. Also preferably, the offset portions 22*a*–22*ff* are offset in directions on both sides of the plane of rotation as shown in FIGS. 4A and 4B. For example, as illustrated in FIG. 1 and more clearly shown in FIG. 3, segments 22*j*, 22*l*, 22*n*, 22*p*, 22*r*, etc. are bent downwardly as shown in FIG. 3 while segments 22*k*, 22*m*, 22*o*, 22*q*, 22*s* and 22*u*, etc. are bent upwardly from the plane of rotation 30 as shown in FIG. 3. As illustrated in FIGS. 1 and 3, the resulting peripheral portion 22 has a wavy or sinuous appearance.

Some of the segments 22*a*–22*ff* include apertures. As shown in FIG. 2 and labeled therein, segments 22*a*, 22*b*, 22*e*, 22*f*, 22*i*, 22*j*, 22*m*, 22*n*, 22*q*, 22*r*, 22*u*, 22*v*, 22*y*, 22*z*, 22*cc* and 22*dd* are provided with holes h in the embodiment illustrated. FIG. 4A is a partial cross-sectional view through the center of segment 22*j*, and FIG. 4B is a partial cross-sectional view through the center of segment 22*i*. As shown in FIGS. 4A and 4B, segments 22*i* and 22*j* are provided with holes h. All of the holes h are alike and the segments in which they are included are shown in FIGS. 1 and 2 and identified above. The holes h have not been given element numbers or labeled in the FIGS. other than FIGS. 4A and 4B to avoid clutter on the drawings in view of their clear locations.

FIG. 5B corresponds to FIG. 4A and illustrates the manner in which the plastic body 23 engages the peripheral portion 22 and specifically, segment 22*j*. As shown in FIG. 5B, the plastic material comprising plastic body 23 has, in molding, flowed through the hole h, and the plastic body 22 is engaged by not only the peripheral portion 22 but also by the hole-forming surfaces of segment 22*j*.

In the embodiment illustrated in FIGS. 1–5B, the peripheral portion 22 is formed so that the segments 22*a*–22*ff* as shown in FIGS. 1–3, are joined by intervening webs which are numbered 24 on FIG. 3, but are only numbered, other than in FIG. 3, in FIG. 2 between segments 22*a* through 22*f* to avoid clutter on the drawings because a multiplicity of element numbers. The webs 24 intervening segments 22*a*–22*ff*, which are all alternatingly deformed on both sides of the plane of rotation 30, engage the plastic portion 23 and transmit rotative force from between the central hub 21 and plastic body 23 with reduced stress concentration as a result of increased areas of surface engagement in the directions of applied loading. Furthermore, the plurality of surfaces 24 permit rotative force to be transferred to the plastic body without a plurality of arms extending from the central hub 21 into the plastic blades. Such a plurality of arms extending outwardly from the central hub into the plastic blades increases the moment of inertia of the composite fan assembly and provides at their interface with the blade-forming plastic material, sharp edges and small radii of curvature providing high-stress concentrations and increased risk of stress cracking as a result of the forces imposed on the air-moving blades by air resistance and the rotative forces imparted to the blades by such arms.

The centrifugal forces created by rotation of the composite fan assembly are resisted by the surfaces of segments 22*a*–22*ff* which are shown in FIGS. 1–5B as upper and lower surfaces. Again, because of the multiplicity of segments 22*a*–22*f*, these load-bearing surfaces of the peripheral portion 22 of the central hub 21 are labeled only in FIGS. 4A, 4B and 5B as 22*j*' and 22*j*" and 22*i*' and 22*i*". As apparent from FIG. 5B, centrifugal force due to the rotation of the composite fan assembly will provide forces within the body of plastic material 23 to the right as shown in FIG. 5B in the direction of the plane of rotation 30. These forces will be resisted in the portion of the composite fan assembly shown in FIG. 5B by the surface 22*j*" of segment 22*j* of the peripheral portion, as well as by the hole-forming surface of segment 22*j*. The composite action of the upper and lower surfaces of segments 22*a*–22*ff* and intervening webs 24 and the holes h provides an interface between hub 21 and plastic body 23 with substantially reduced stress concentrations and risk of stress cracking and reduced moments of inertia in the plane of rotation 30 thereby providing a more durable and reliable composite fan assembly.

In one example of an embodiment of FIGS. 1–5B, the central hub 21 has an outside diameter of about 10 inches and includes a central planar portion 21*a* with an outside diameter of about 7 inches. Six hub driving holes 29*a*–29*f* are equally spaced within the central portion 21*a* on a circle with a radius of 3 inches from the central axis 21*b* of the central hub 21. A frustoconical annulus 21*c* extends outwardly from the central portion 21*a* and displaces the peripheral portion 22 of the central hub 21 about ½ inch from the plane of the central portion 21*a*. A peripheral portion 22 extends radially outwardly a distance of about ¾ of an inch from the peripheral portion of the frustoconical annulus 21*c*, and its outermost portion, comprising a radial distance of about 0.47 inches is offset from its plane of rotation 30, by thirty-two joined segments 22*a*–22*ff*, each segment having a peripheral length of about 0.415 inches. The segments 22*a*–22*ff* are bent from the plane of rotation 30 alternatingly in both directions at an angle $\alpha$ of about 30°. As indicated above, segments 22*a*, 22*b*, 22*e*, 22*f*, 22*i*, 22*j*, 22*m*, 22*n*, 22*q*, 22*r*, 22*u*, 22*v*, 22*y*, 22*z*, 22*cc* and 22*dd* are provided with holes h having diameters of about 0.250 inches.

Computer analysis of the stresses within the plastic material in a composite fan assembly of FIGS. 1–5B indicate that maximum stress concentrations in the composite fan assembly of the invention can be substantially reduced. Computer comparison of the example described above and a prior composite fan indicate maximum stress reductions from about ⅕ to about 1/10 the maximum stress concentrations which were achievable before the invention. For example, a prior art composite fan assembly included the planar central metallic hub having an octagonally shaped perimeter with rounded corners, and the peak stress concentrations within the blade-forming plastic body interfacing this periphery were from 5 to 10 times as high as those achieved with the invention. The invention permits reduced sections in the plastic body 23, saving materials and weight and permitting reduced costs. A reduction in stress at the areas of stress concentration achieved with the invention reduces the potential of stress fractures and the possibility for failure of the plastic material.

Although the embodiment illustrated in FIGS. 1–5B is formed with the plurality of small planar segments 22*a*–22*ff* at the periphery of the metal hub 21 bent in both directions from the plane of rotation, a central metal hub of the invention may be formed with a smoothly curving or sinuous deformation of the periphery of the metal plate to provide an undulating or wavy periphery for interfacing the plastic body 23.

It is preferable that the metal hub be formed with rotational symmetry about its central axis of rotation so that it will be rotationally balanced and be free of unbalanced rotational forces during its rotation. As is noted in FIGS. 1 and 2, each of the holes in the central hub 21, whether placed for mounting as with holes 29*a*–29*f* or to interface the plastic body 23 as with holes h, are arranged in a manner such that the sum of the balance moments for all holes substantially result in negligible unbalance.

Figure 6:
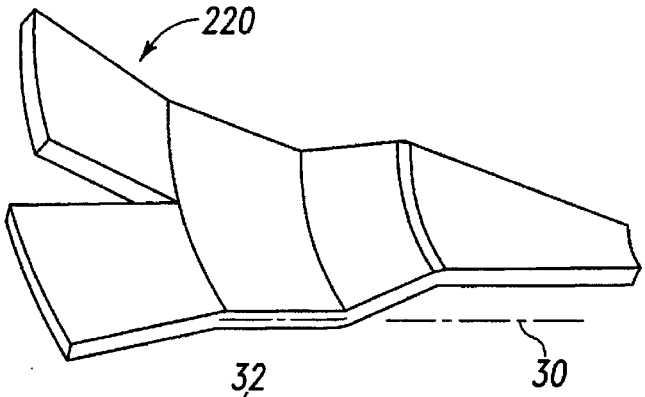

In addition, while FIGS. 1–5B illustrate an embodiment in which the segments 22*a*–22*ff* are deformed from the plane of rotation 30 in the radial direction and interconnected by webs 24, a central hub of the invention may also be formed by severing the metal sheet and deforming the segments in the radial direction (without the intervening webs 24) as shown in FIG. 6. In addition, although not shown in the drawings, offset peripheral segments may be formed by severing the metal sheet both radially and tangentially adjacent its periphery (that is, with an L-shaped cut with a radial leg intersecting the periphery of the hub and the orthogonal leg of the L lying substantially tangentially to the periphery of the hub) and offsetting the resulting segment formed by the L cut in one direction from the plane of rotation or alternatingly on both sides of the plane of rotation (in a somewhat like manner to that shown in FIGS. 1–5B).

Figure 7:
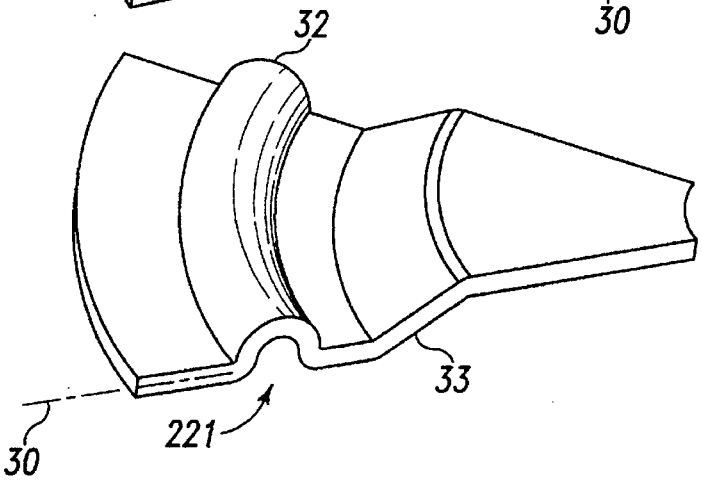
Figure 8:
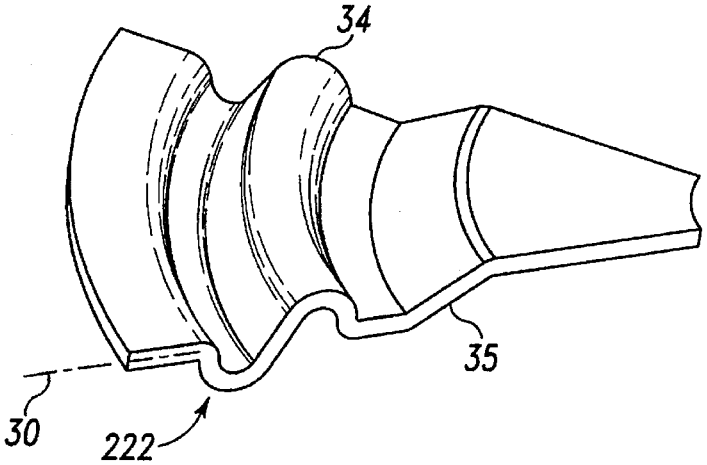
Figure 9:
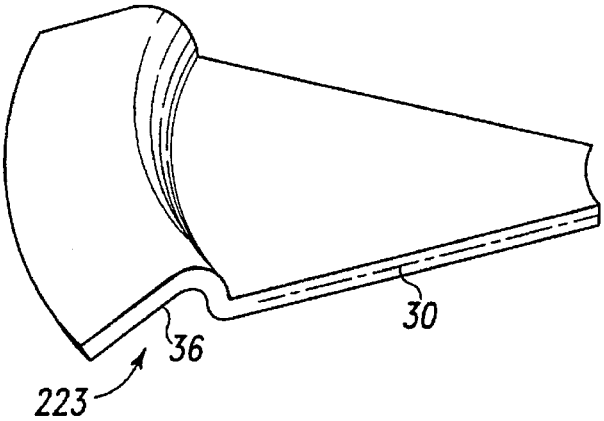
Figure 10:
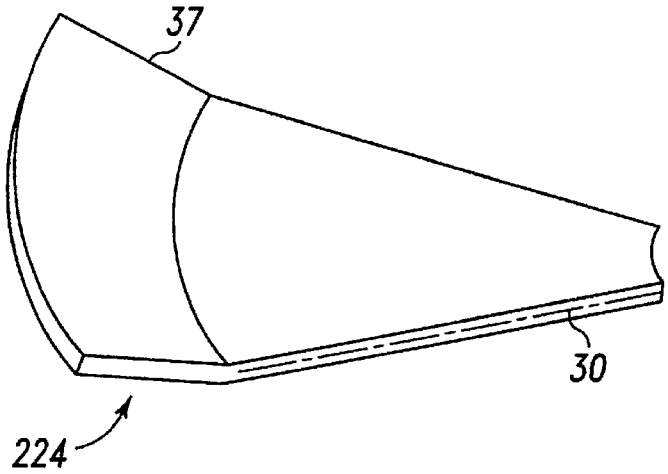
Figure 11:
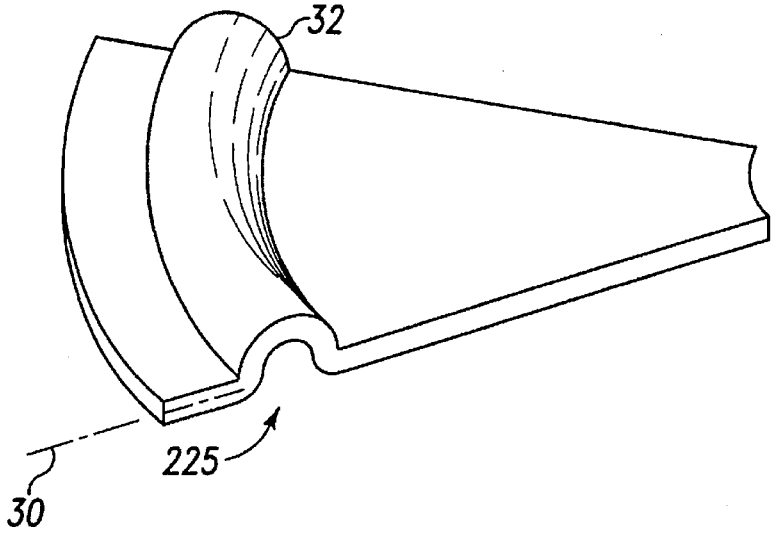
Figure 12:
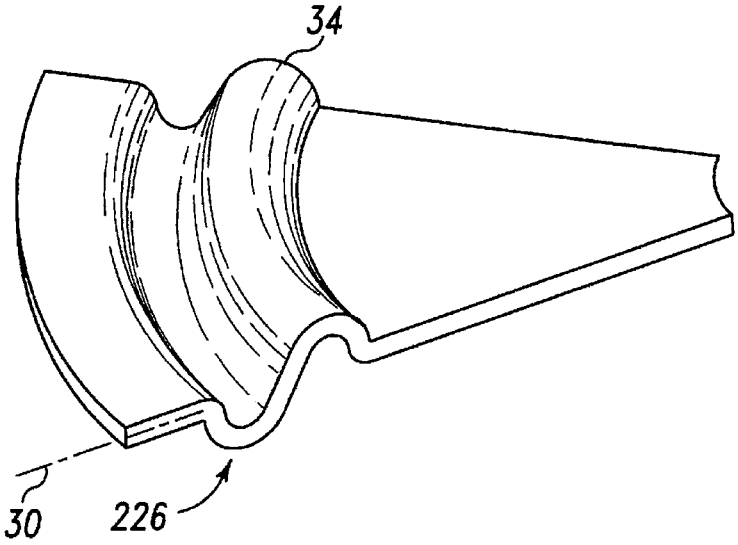

FIGS. 6–12 illustrate segments taken from the periphery from alternative embodiments of metal hubs of the invention to illustrate other means of forming the offset peripheral portion of the metal hub. FIGS. 7 and 11 illustrate that the offset portion 32 may be formed as an annular portion which is deformed from the plane of rotation 30 with a semicircular cross-section. The FIG. 7 embodiment includes a frustoconical annulus 33 between its peripheral portion 221 and the central hub portion, while FIG. 11 is substantially planar except for offset annular portion 32. In preferred embodiments, the annular portion 32 of FIGS. 7 and 11 would preferably be formed around the entire periphery of the metal hub, but it would not be necessary in the invention that the offset annular portion be continuous, but to the contrary, the offset peripheral portion may be formed as a plurality of discontinuous offset annular portions. FIGS. 8 and 12 show a peripheral portions 222 and 226 respectively formed with an offset portion 34 having an S-shaped cross-section which can be continuous about the periphery of the central hub or can be broken into a plurality of offset sections at the periphery. As with FIGS. 7 and 11, FIG. 8 indicates a frustoconical annulus 35 formed in the metal hub, while FIG. 12 indicates the metal hub as being substantially planar. FIG. 9 is a variation of the offset portion of FIGS. 7 and 11 including a portion 36 with a partially semi-circular cross-section and a frustoconical terminal peripheral portion extending from the partially semicircular portion to the periphery of the metal hub rather than terminating in an extension in the plane of rotation as shown in FIGS. 7 and 11. FIG. 10 illustrates a metal hub in which the offset portion 37 is simply formed by offsetting the peripheral portion from the plane of rotation at an acute angle to form a frustoconical portion at the periphery of the metal hub.

Thus, in the invention one or more offset peripheral portions of the central metal hub interface with the plastic body 23 forming air-moving blades to and resist centrifugal forces imposed on the plastic body in operation, with reduced stress concentration created at the interface. Some embodiments of the invention such as the embodiments of FIGS. 1–6 also provide offset peripheral portions that interface with the plastic body 23 to transfer rotative forces and resist tangential forces at the interface. The invention thus provides a method of reducing stress concentration in the plastic body molded to the central metallic hub which is driven about its central axis by providing the periphery of the central hub, and its interface with the plastic body, with one or more peripheral segments that are displaced from the plane of rotation central hub in the direction of the central axis about which it is driven.

Metal hubs of the invention may be easily formed by a single tool in a single operation by stamping them from a metal sheet and simultaneously adapting the metal hub for rotation and for engagement with the plastic body by offsetting at least one peripheral portion from its plane of rotation as described herein. It will be apparent, however, that the offset peripheral portion or portions can be formed, at somewhat greater expense, by fastening one or more offset portions at the periphery of the metal hub by welding or other fastening means, and possibly as simply as providing a plurality of rivets through the periphery of the metal hub with no purpose other than to provide a plurality of offset peripheral portions.

Those skilled in the art will recognize that embodiments other than those described above and illustrated herein may be made without departing from the scope of the invention. Accordingly, the invention is limited only by the prior art and the scope of the following claims.

We claim:

1. A fan assembly comprising:

a metal hub adapted for rotation and for engagement with a plastic body, said metal hub including at least one peripheral portion bent to be offset from its plane of rotation, said metal hub being formed by simultaneously stamping it from a metal sheet and forming the peripheral portion, and a plastic body forming a plurality of air-moving blades molded in engagement with said at least one offset peripheral portion of said metal hub.

2. The fan assembly of claim 1 wherein said at least one offset peripheral portion comprises an annular portion formed adjacent the periphery of the metal hub.

3. The fan assembly of claim 2 wherein said annular portion comprises an annulus offset from the plane of rotation.

4. The fan assembly of claim 3 wherein said metal hub is formed by simultaneously stamping it from a metal sheet and forming the peripheral annulus.

5. The fan assembly of claim 1 wherein one or more openings are formed in the peripheral portion of the metal hub and are engaged by the plastic body.

6. The fan assembly of claim 4 wherein the annulus has an arcuate cross-section.

7. The fan assembly of claim 1 wherein a plurality of peripheral portions of the metal hub are offset from their plane of rotation.

8. The fan assembly of claim 7 wherein the plurality of peripheral portions comprise at least two portions of the periphery of the metal hub bent out of the plane of rotation.

9. The fan assembly of claim 8 wherein the at least two offset portions extend out of the plane of rotation at an acute angle of from about 10° to about 30°.

10. The fan assembly of claim 9 wherein the at least two offset portions are offset in the direction of only one side of the plane of rotation.

11. The fan assembly of claim 9 wherein the at least two offset portion are offset in the directions of both sides of the plane of rotation.

12. The fan assembly of claim 7 wherein the plurality of offset peripheral portions are fastened to the metal hub.

13. The fan assembly of claim 12 wherein the plurality of offset peripheral portions comprise a plurality of rivets over which the plastic body is formed.

14. The fan assembly of claim 7 wherein the plurality of peripheral portions are formed by a wavy peripheral portion of the metal hub.

15. The fan assembly of claim 1 wherein said metal hub comprises a central portion adapted for rotation by fastening to a rotating driver, a frusto-conical portion extending outwardly from the central portion to the peripheral portion lying generally in said plane of rotation and including the at least one offset peripheral portion.

16. The fan assembly of claim 15 wherein said at least one peripheral portion comprises a plurality of joined waffle-like peripheral segments that are alternatingly displaced in both directions from their plane of rotation.

17. The fan assembly of claim 15 wherein the central portion of the metal hub is substantially planar.

18. A fan hub adapted to be joined to a plastic blade-forming body, comprising a portion adapted to be driven in rotation including at least one peripheral portion bent to be offset from the plane of its rotation for engagement with the plastic body, and formed from a metal sheet by a single tool that simultaneously forms the hub and the at least one offset peripheral portion.

19. The fan hub of claim 18 as formed from a metal sheet by a single tool that simultaneously forms the hub and the at least one offset peripheral portion.

20. The fan hub of claim 19 wherein the at least one offset peripheral portion comprises a peripheral annulus bent from the plane of rotation of said portion.

21. The fan hub of claim 20 wherein the peripheral annulus has an arcuate cross-section.

22. The fan hub of claim 18 wherein the at least one offset peripheral portion comprises a plurality of segments at the periphery of the planar portion bent out of their plane of rotation.

23. A fan hub adapted to be joined to a plastic blade-forming body, comprising a metal portion adapted to engage said plastic body and be rotated in a plane of rotation, said metal portion including at least two body engaging portions of the periphery of the metal portion bent out of, and offset from, the plane of rotation.

24. A fan hub comprising:

a substantially planar central portion adapted to be rotated; and a peripheral segment comprising at least two portions bent out of the plane of rotation of the peripheral segment.

25. The hub of claim 24 wherein the plurality of member portions includes a first plurality of member portions extending at an acute angle away from one side of said plane of rotation and a second plurality of member portions extending at an acute angle away from the opposite side of said plane of rotation.

26. The hub of claim 25 wherein the first and second plurality of member portions alternate in the peripheral segment and are joined by intervening webs.

27. The hub of claim 25 wherein a fan blade unit is molded to the peripheral segment and the plurality of member portions are formed for the reduction of stress concentration in the fan blade unit.

28. The hub of claim 27 wherein the member portions include a plurality of holes and the fan blade unit fills the plurality of holes and surrounds each of the plurality of member portions on three sides.

29. A fan hub comprising:

a central planar portion having an axis of rotation; a frusto-conical annular portion between the central planar portion and a peripheral portion, said peripheral portion extending radially outwardly from the frusto-conical portion and lying in a plane offset from, and substantially parallel to the central planar portion;

said peripheral portion including a plurality of segments comprising at least two segments bent at an acute angle out of the plane of the peripheral portion for engaging a plurality of fan blades.

30. The fan hub of claim 29 wherein the peripheral portion includes a plurality of holes.

31. The fan hub of claim 30 wherein the plurality of holes includes a plurality of pairs of holes, each pair of holes including a hole in each of two adjoining segments.

32. The fan hub of claim 31 wherein the plurality of fan blades are molded to the peripheral portion and engage the plurality of segments, each of the plurality of pairs of holes being centered on one of the plurality of fan blades.

33. A fan assembly comprising:

a metal hub adapted for rotation, a unitary plastic portion molded to the metallic hub and forming a plurality of fan blades;

said hub being engaged with the plurality of fan blades, said hub including a plurality of planar, non-parallel peripheral surfaces for applying, during rotation, radial and centripetal forces to the unitary plastic molded portion.

34. The fan assembly of claim 33 wherein the plurality of planar, non-parallel peripheral surfaces includes a first plurality of surfaces disposed at an angle to a plane of the hub and a second plurality of surfaces disposed at an equal and opposite angle to the plane of the hub.

35. The fan assembly of claim 34 wherein the plurality of planar, non-parallel, peripheral surfaces includes a plurality of holes.

36. The fan assembly of claim 35 wherein the plurality of holes includes at least one pair of holes formed in two adjacent planar, non-parallel peripheral surfaces.

37. A fan comprising:

a hub for rotation of the fan, including a peripheral edge having a plurality of edge segments comprising at least two edge segments bent out of the plane of rotation of the peripheral edge; and a plurality of plastic blades coupled to the peripheral edge of the hub.

38. The fan of claim 37 wherein each of the plurality of plastic blades is coupled to the peripheral edge of the hub by blade-engaging surfaces of the edge segments, said blade-engaging surfaces applying radial and centripetal force to the blades.

39. The fan of claim 38 wherein the plurality of blade-engaging surfaces include a plurality of hole-forming surfaces in engagement with the blades.

40. In a method of reducing stress concentration in a plastic body molded onto a central metallic hub and driven about its central axis, the improvement comprising:

forming the central metallic hub by stamping it from a metal sheet, and providing the periphery of the central hub that interfaces with the plastic body molded thereto with at least one peripheral segment that is bent from the central hub in the direction of its central axis.

41. The method of claim 40 wherein a plurality of peripheral segments of the central portion are displaced from the central hub in both directions along the central axis.

42. The method of claim 41 wherein the peripheral segments are uniformly spaced about the periphery of the central hub.

* * * * *